US012330045B2

(12) United States Patent
Alvarez

(10) Patent No.: US 12,330,045 B2
(45) Date of Patent: Jun. 17, 2025

(54) MOTORIZED SKATEBOARD ASSEMBLY

(71) Applicant: Monica Alvarez, Houston, TX (US)

(72) Inventor: Monica Alvarez, Houston, TX (US)

( * ) Notice: Subject to any disclaimer, the term of this patent is extended or adjusted under 35 U.S.C. 154(b) by 222 days.

(21) Appl. No.: 18/111,968

(22) Filed: Feb. 21, 2023

(65) Prior Publication Data

US 2024/0278110 A1 Aug. 22, 2024

(51) Int. Cl.

*A63C 17/12* (2006.01)
*A63C 17/01* (2006.01)
*A63C 17/14* (2006.01)

(52) U.S. Cl.

CPC ..... *A63C 17/12* (2013.01); *A63C 17/012* (2013.01); *A63C 17/015* (2013.01); *A63C 2017/1463* (2013.01); *A63C 2203/12* (2013.01)

(58) Field of Classification Search

CPC ..... A63C 17/12; A63C 17/011; A63C 2017/1463; A63C 2203/12

See application file for complete search history.

(56) References Cited

U.S. PATENT DOCUMENTS 6,796,394 B1 * 9/2004 Lin ..... A63C 17/12 180/181
9,387,388 B2 7/2016 King
D835,220 S 12/2018 Treadway
10,369,454 B2 8/2019 Green
10,926,162 B2 * 2/2021 Han ..... A63C 17/223
11,148,038 B2 10/2021 Ulmen
11,161,031 B2 11/2021 Anning
11,167,200 B2 11/2021 Treadway
11,697,470 B1 * 7/2023 Wang ..... A63C 17/04 180/220
2009/0071740 A1 * 3/2009 Palmer ..... B62K 23/08 180/216
2013/0206493 A1 * 8/2013 Larson ..... A63C 17/012 180/181
2014/0332297 A1 11/2014 Palacio
2018/0280786 A1 10/2018 Wahba
2018/0361226 A1 * 12/2018 Cho ..... B62K 3/002

FOREIGN PATENT DOCUMENTS

WO WO2018170528 9/2018

* cited by examiner

*Primary Examiner* — Brian L Swenson

(57) ABSTRACT

A motorized skateboard assembly for driving and steering using an input which is operated by a user's feet includes a platform with wheels attached via brackets. A drive system is operatively coupled to the wheels, and an input is electrically coupled to the drive system to operate the wheels. The input is mounted on a top side of the platform for operation by the user's feet. The input includes actuators for driving the platform forward, braking the wheels, and steering the platform while driving it forward.

15 Claims, 5 Drawing Sheets

MOTORIZED SKATEBOARD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to motorized skateboards and more particularly pertains to a new motorized skateboard for driving and steering using an input which is operated by a user's feet.

(2) Description of Related Art Including Information Disclosed Under 37 CFR 1.97 and 1.98

The prior art provides several examples of motorized skateboards that are operated by a controller held in the hands of a user. The prior art also includes motorized skateboards which use an input mounted on top of a riding platform of the skateboard so that the input is actuatable by a user's feet. In both U.S. Pat. No. 10,926,162 and U.S. Pat. Application No. 2018/0280786, a motor is activated to drive wheels of the skateboard to drive the skateboard when the skateboard is already in motion and an input on top of the riding platform of the skateboard is actuated. The motors in these examples are activated only to assist in moving the already-moving skateboard. These skateboards are also not steerable by the motors.

It is desirable to provide a motorized skateboard which provides a drive system for propelling, braking, and steering the skateboard, and which may be operated by a user through an input mounted to the top of the riding platform of the skateboard. Such an arrangement will allow a user to ride a skateboard without pushing on the ground to propel or stop the skateboard and without the physical effort required to steer using conventional skateboard trucks. This arrangement is not provided by the prior art.

BRIEF SUMMARY OF THE INVENTION

An embodiment of the disclosure meets the needs presented above by generally comprising a platform with a front end and a rear end. Each of a front bracket and a rear bracket is coupled to a bottom side of the platform, and the front bracket is spaced forwardly of the rear bracket with respect to the rear end of the platform. At least one front wheel is rotatably coupled to the front bracket, and at least one rear wheel is rotatably coupled to the rear bracket. Each of the at least one front wheel and the at least one rear wheel is configured to be engageable with a support surface to compel the platform along the support surface when rotated. A drive system is operatively coupled to each of the at least one front wheel and the at least one rear wheel for rotating each of the at least one front wheel and the at least one rear wheel.

A control circuit is operatively coupled to the drive system, and an input is electrically coupled to the control circuit for operating the drive system. The input is coupled to a top side of the platform and is actuatable to compel the platform forwardly. The input is also actuatable to steer the front end of the platform toward either of the first lateral direction and the second lateral direction with respect to the rear end of the platform. A power supply is electrically coupled to the control circuit and is mounted to the bottom side of the platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
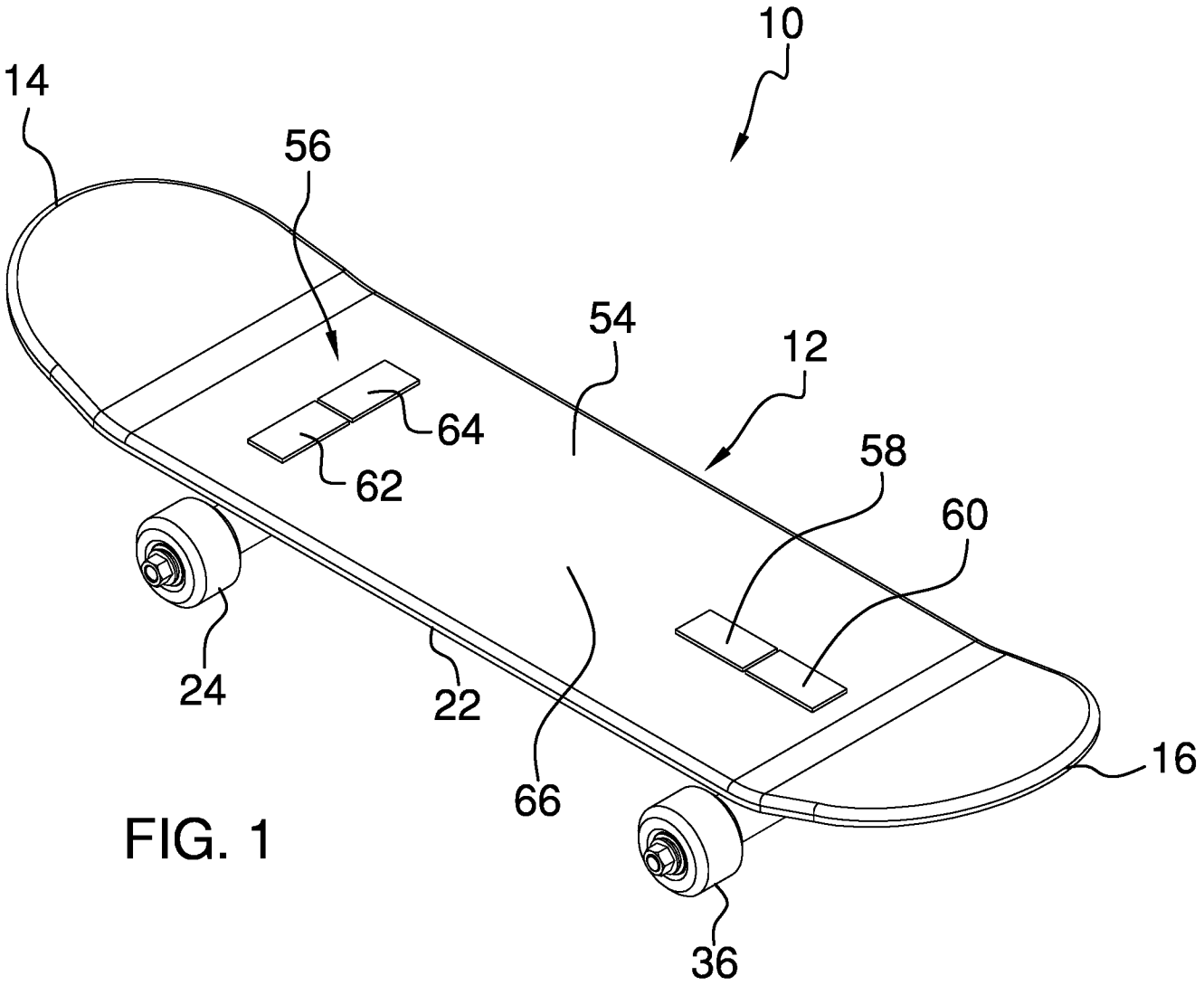
FIG. 1 is a top rear side perspective view of a motorized skateboard assembly according to an embodiment of the disclosure.
Figure 2:
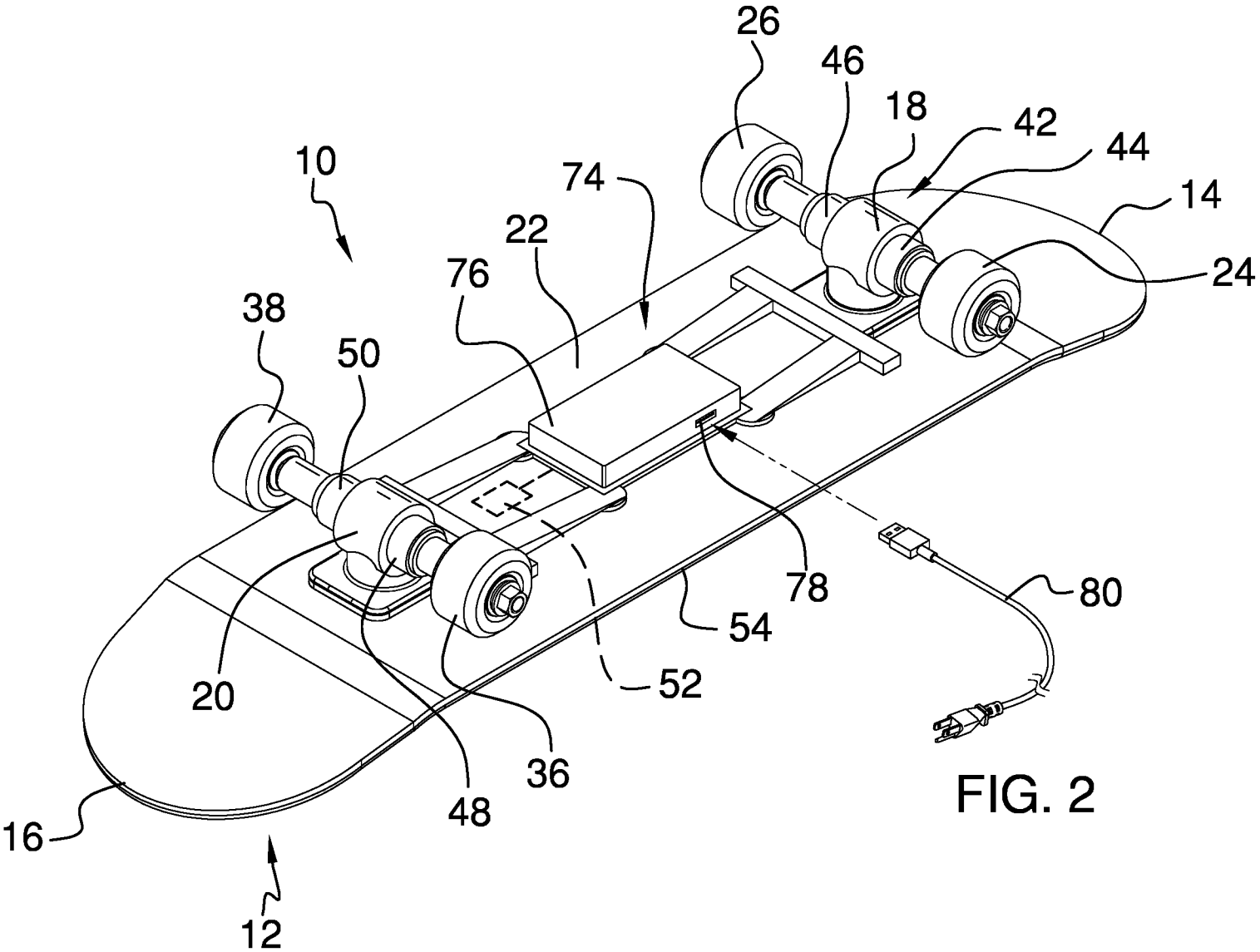
FIG. 2 is a bottom rear side perspective view of an embodiment of the disclosure.
Figure 3:
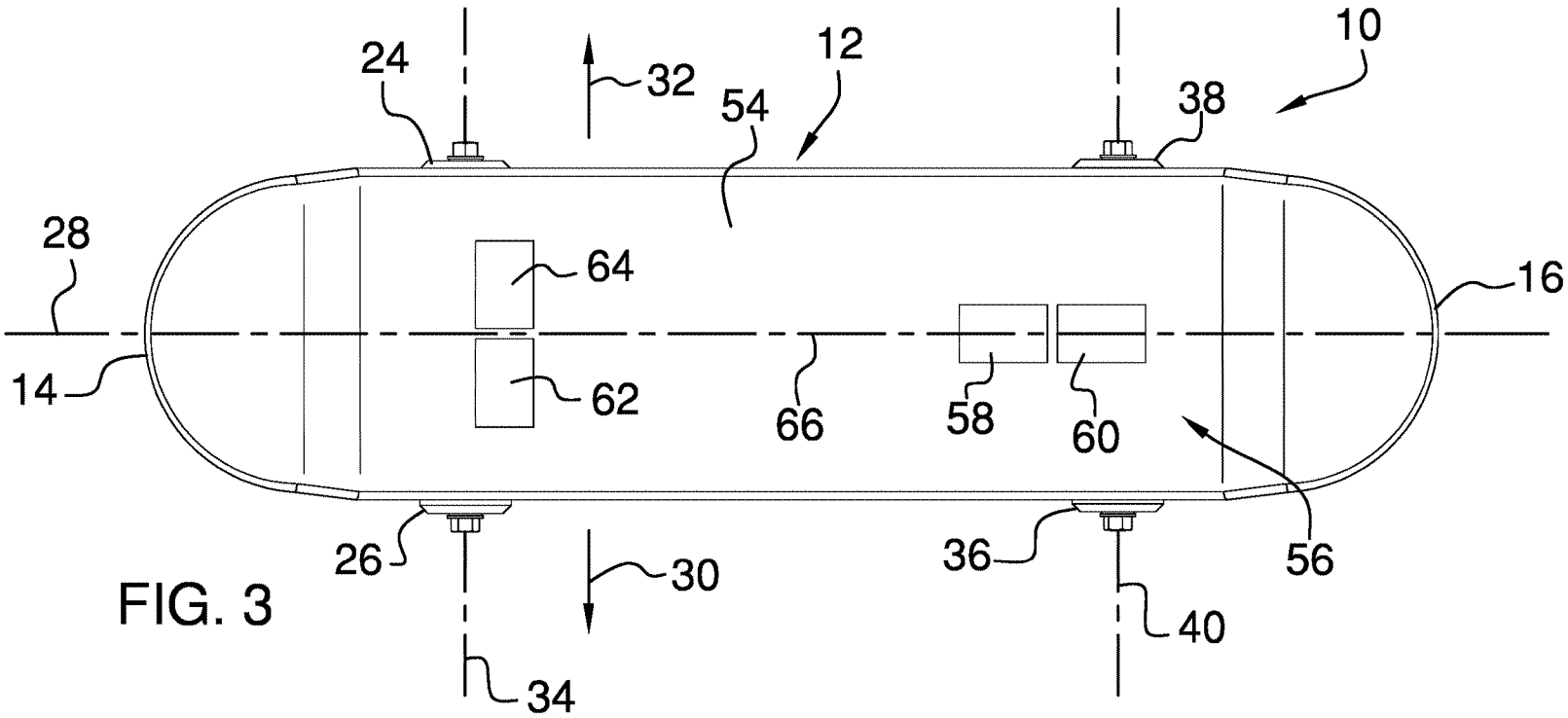
FIG. 3 is a top view of an embodiment of the disclosure.
Figure 4:
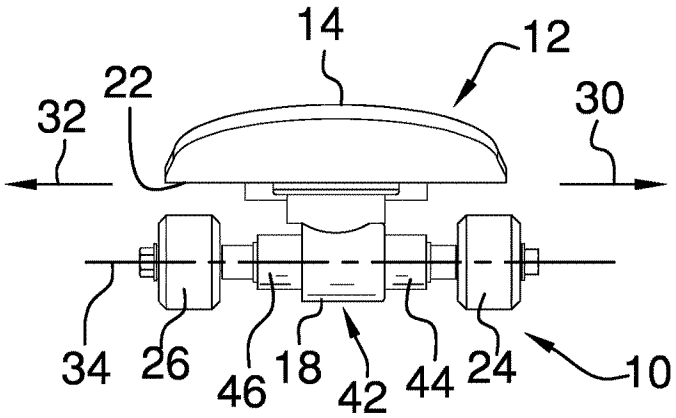
FIG. 4 is a front view of an embodiment of the disclosure.
Figure 5:
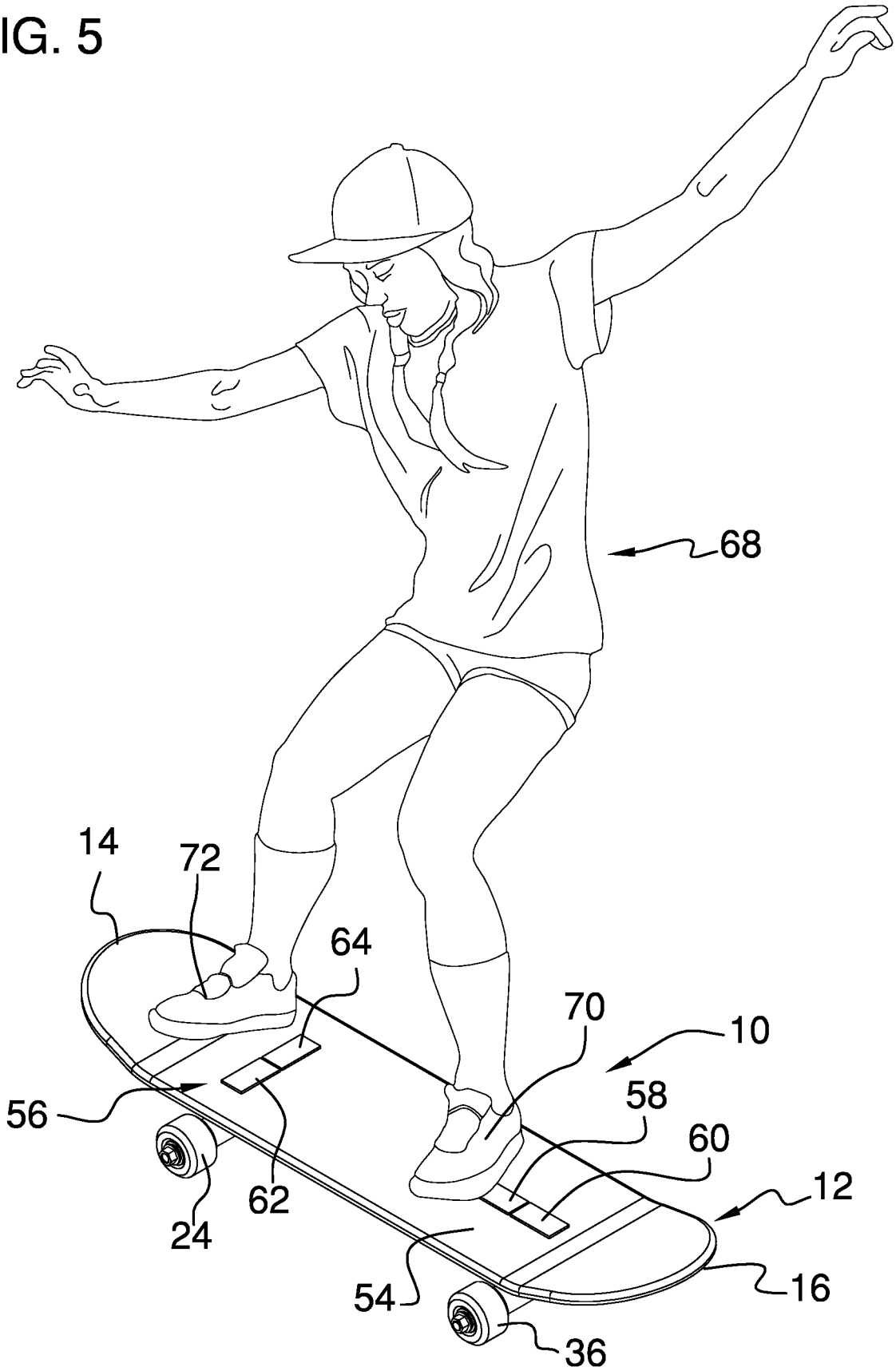
FIG. 5 is an in-use view of an embodiment of the disclosure.
Figure 6:
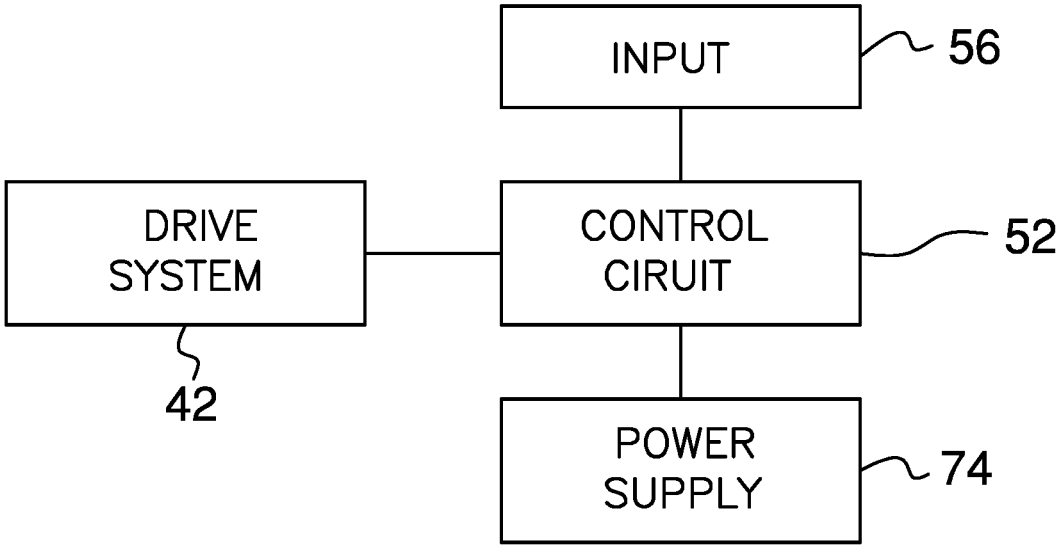
FIG. 6 is a block diagram of an embodiment of the disclosure.

With reference now to the drawings, and in particular to FIGS. 1 through 6 thereof, a new motorized skateboard embodying the principles and concepts of an embodiment of the disclosure and generally designated by the reference numeral 10 will be described.

As best illustrated in FIGS. 1 through 6, the motorized skateboard assembly 10 generally comprises a platform 12 with a front end 14 and a rear end 16. Each of a front bracket 18 and a rear bracket 20 is coupled to a bottom side 22 of the platform 12, and the front bracket 18 is spaced forwardly of the rear bracket 20 with respect to the rear end 16 of the platform 12.

A first front wheel 24 and a second front wheel 26 are each rotatably coupled to the front bracket 18. The first front wheel 24 is spaced from a central axis 28 of the platform 12 extending between each of the front and rear ends 14, 16 of the platform 12 in a first lateral direction 30. The second front wheel 26 is spaced from the central axis 28 in a second lateral direction 32 opposite the first lateral direction 30. The first and second front wheels 24, 26 share a front rotational axis 34 which extends laterally in opposite directions with respect to the central axis 28. A first rear wheel 36 and a second rear wheel 38 are each rotatably coupled to the rear bracket 20. The first rear wheel 36 is spaced from the central axis 28 in the first lateral direction 30, and the second rear wheel 38 is spaced from the central axis 28 in the second lateral direction 32. The first and second rear wheels 36, 38 sharing a rear rotational axis 40 which extends laterally in opposite directions with respect to the central axis 28. Each of the first front wheel 24, the second front wheel 26, the first rear wheel 36, and the second rear wheel 38 is configured to be engageable with a support surface to compel the platform 12 along the support surface when rotated.

A drive system 42 is operatively coupled to each of the first and second front wheels 24, 26 and the first and second rear wheels 36, 38 for rotating each of the first and second front wheels 24, 26 and the first and second rear wheels 36, 38. The drive system 42 comprises a first front motor 44 which is mounted on the front bracket 18 and is operatively coupled to the first front wheel 24, a second front motor 46 which is mounted on the front bracket 18 and is operatively coupled to the second front wheel 26, a first rear motor 48 which is mounted on the rear bracket 20 and is operatively coupled to the first rear wheel 36, and a second rear motor 50 which is mounted on the rear bracket 20 and is operatively coupled to the second rear wheel 38.

A control circuit 52 is operatively coupled to the drive system 42. An input 54 is mounted to a top side 56 of the platform 12 and is electrically coupled to the control circuit 52 for operating the drive system 42. The input 54 comprises a forward drive actuator 58, a brake actuator 60, a first steer actuator 62, and a second steer actuator 64. The forward drive actuator 58 is actuatable to rotate at least one of the first front wheel 24, the second front wheel 26, the first rear wheel 36, and the second rear wheel 38 such that the platform 12 moves forwardly. A brake actuator 60 is actuatable to inhibit rotation of each of the first front wheel 24, the second front wheel 26, the first rear wheel 36, and the second rear wheel 38.

The first steer actuator 62 is actuatable to rotate at least some of the first front wheel 24, the second front wheel 26, the first rear wheel 36, and the second rear wheel 38 such that the front end 14 of the platform 12 is steered toward the first lateral direction 30 with respect to the rear end 16 of the platform 12. For example, the first steer actuator 62 may rotate the first front wheel 24 and the first rear wheel 36 at a slower rotational speed than a rotational speed of the second front wheel 26 and the second rear wheel 38, which compels the platform 12 to move such that the front end 14 of the platform 12 leads the rear end 16 of the platform 12 along a path curving toward the first lateral direction 30. The control circuit 52 may be programmed to steer in this way only when the first steer actuator 62 and the forward drive actuator 58 are simultaneously actuated. The first steer actuator 62 may also actuate the first front wheel 24 and the first rear wheel 36 in an opposite rotational direction to a rotation of the second front wheel 26 and the second rear wheel 38 to pivot the platform 12 about a center 66 of the platform 12 such that the front end 14 of the platform 12 is steered toward the first lateral direction 30 with respect to the rear end 16 of the platform 12.

The second steer actuator 64 is actuatable to rotate at least some of the first front wheel 24, the second front wheel 26, the first rear wheel 36, and the second rear wheel 38 such that the front end 14 of the platform 12 is steered toward the second lateral direction 32 with respect to the rear end 16 of the platform 12. For example, the second steer actuator 64 may rotate the second front wheel 26 and the second rear wheel 38 at a slower rotational speed than a rotational speed of the first front wheel 24 and the first rear wheel 36, which compels the platform 12 to move such that the front end 14 of the platform 12 leads the rear end 16 of the platform 12 along a path curving toward the second lateral direction 32. The control circuit 52 may be programmed to steer in this way only when the second steer actuator 64 and the forward drive actuator 58 are simultaneously actuated. The second steer actuator 64 may also actuate the second front wheel 26 and the second rear wheel 38 in an opposite rotational direction to a rotation of the first front wheel 24 and the first rear wheel 36 to pivot the platform 12 about a center 66 of the platform 12 such that the front end 14 of the platform 12 is steered toward the second lateral direction 32 with respect to the rear end 16 of the platform 12.

The brake actuator 60 is positioned rearwardly of and adjacent to the forward drive actuator 58. The first steer actuator 62 is spaced forwardly from the forward drive actuator 58 with respect to the platform 12. The second steer actuator 64 is spaced forwardly from the forward drive actuator 58 with respect to the platform 12. The second steer actuator 64 is also positioned adjacent to the first steer actuator 62 and extending in the second lateral direction 32 away from the first steer actuator 62. The forward drive actuator 58 and the brake actuator 60 are positioned to be adjacent to a rearwardly positioned foot 70 of a user 68 standing on the top side 56 of the platform 12, and the first and second steer actuators 62, 64 are positioned to be adjacent to a forwardly positioned foot 72 of the user 68.

A power supply 74 is electrically coupled to the control circuit 52 and is mounted to the bottom side 22 of the platform 12. The power supply 74 comprises a battery 76. A charging port 78 is electrically coupled to the battery 76, and a charging cord 80 is provided which is couplable to the charging port 78 for electrically coupling the battery 76 to an external power source to charge the battery 76.

In use, the user 68 stands on the top side 56 of the platform 12 with the rearwardly positioned foot 70 positioned rearwardly of the forwardly positioned foot 72 with respect to the platform 12. The rearwardly positioned foot 70 is also positioned adjacent to the forward drive actuator 58 and the brake actuator 60, while the forwardly positioned foot 72 is positioned adjacent to the first and second steer actuators 62, 64. The user 68 actuates the forward drive actuator 58 to move forward and the brake actuator 60 to slow to a stop. The user 68 actuates the first steer actuator 62 while actuating the forward drive actuator 58 to steer toward the first lateral direction 30 while moving forward and actuates the second steer actuator 64 while actuating the forward drive actuator 58 to steer toward the second lateral direction 32 while moving forward.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized skateboard assembly comprising:

a platform having a front end and a rear end;

a front bracket and a rear bracket each being coupled to a bottom side of the platform, the front bracket being spaced forwardly of the rear bracket with respect to the rear end of the platform;

at least one front wheel being rotatably coupled to the front bracket;

at least one rear wheel being rotatably coupled to the rear bracket;

each of the at least one front wheel and the at least on rear wheel being configured to be engageable with a support surface to compel the platform along the support surface when rotated;

a drive system being operatively coupled to each of the at least one front wheel and the at least one rear wheel for rotating each of the at least one front wheel and the at least one rear wheel;

a control circuit being operatively coupled to the drive system;

an input being electrically coupled to the control circuit for operating the drive system, the input being coupled to a top side of the platform, the input being actuatable to compel the platform forwardly, the input being actuatable to steer the front end of the platform toward either of the first lateral direction and the second lateral direction with respect to the rear end of the platform;

a power supply being electrically coupled to the control circuit, the power supply being mounted to the bottom side of the platform;

wherein the drive system comprises at least one front motor being mounted on the front bracket and being operatively coupled to the at least one front wheel, and at least one rear motor being mounted on the rear bracket and being operatively coupled to the at least one rear wheel;

wherein the at least one front wheel comprises a first front wheel and a second front wheel, the first front wheel being spaced from a central axis of the platform extending between each of the front and rear ends of the platform in a first lateral direction, the second front wheel being spaced from the central axis in a second lateral direction opposite the first lateral direction;

wherein the at least one rear wheel comprises a first rear wheel and a second rear wheel, the first rear wheel being spaced from the central axis in the first lateral direction, the second rear wheel being spaced from the central axis in the second lateral direction; and wherein the input comprises a forward drive actuator being actuatable to rotate at least one of the first front wheel, the second front wheel, the first rear wheel, and the second rear wheel such that the platform moves forwardly, the forward drive actuator being positioned on the top side of the platform forward of the first rear wheel and the second rear wheel and spaced rearwardly from the first front wheel and the second front wheel, the forward drive actuator being positioned closer to the first rear wheel and the second rear wheel than to the first front wheel and the second front wheel, a first steer actuator being actuatable to rotate at least some of the first front wheel, the second front wheel, the first rear wheel, and the second rear wheel such that the front end of the platform is steered toward the first lateral direction with respect to the rear end of the platform, a second steer actuator being actuatable to rotate at least some of the first front wheel, the second front wheel, the first rear wheel, and the second rear wheel such that the front end of the platform is steered toward the second lateral direction with respect to the rear end of the platform.

2. The assembly of claim 1, wherein the at least one front wheel comprises a first front wheel and a second front wheel, the first front wheel being spaced from a central axis of the platform extending between each of the front and rear ends of the platform in a first lateral direction, the second front wheel being spaced from the central axis in a second lateral direction opposite the first lateral direction.

3. The assembly of claim 2, wherein the first and second front wheels share a front rotational axis, the front rotational axis extending laterally in opposite directions with respect to the central axis.

4. The assembly of claim 1, wherein the at least one rear wheel comprises a first rear wheel and a second rear wheel, the first rear wheel being spaced from the central axis in the first lateral direction, the second rear wheel being spaced from the central axis in the second lateral direction.

5. The assembly of claim 4, wherein the first and second rear wheels share a rear rotational axis, the rear rotational axis extending laterally in opposite directions with respect to the central axis.

6. The assembly of claim 1, wherein:

the at least one front wheel comprises a first front wheel and a second front wheel, the first front wheel being spaced from a central axis of the platform extending between each of the front and rear ends of the platform in a first lateral direction, the second front wheel being spaced from the central axis in a second lateral direction opposite the first lateral direction; and the at least one front motor includes:

a first front motor being mounted on the front bracket and being operatively coupled to the first front wheel; and a second front motor being mounted on the front bracket and being operatively coupled to the second front wheel.

7. The assembly of claim 1, wherein:

the at least one rear wheel comprises a first rear wheel and a second rear wheel, the first rear wheel being spaced from the central axis in the first lateral direction, the second rear wheel being spaced from the central axis in the second lateral direction; and the at least one rear motor includes:

a first rear motor being mounted on the rear bracket and being operatively coupled to the first rear wheel; and a second rear motor being mounted on the rear bracket and being operatively coupled to the second rear wheel.

8. The assembly of claim 1, wherein the input includes:

a forward drive actuator being actuatable to rotate at least one of the at least one front wheel and the at least one rear wheel such that the platform moves forwardly;

a first steer actuator being actuatable to steer the front end of the platform toward the first lateral direction with respect to the rear end of the platform; and a second steer actuator being actuatable to steer the front end of the platform toward the second lateral direction with respect to the rear end of the platform.

9. The assembly of claim 1, wherein the input includes a brake actuator being actuatable to inhibit rotation of each of the at least one front wheel and the at least one rear wheel.

10. The assembly of claim 1, wherein the input further includes a brake actuator being actuatable to inhibit rotation of each of the first front wheel, the second front wheel, the first rear wheel, and the second rear wheel, the brake actuator being positioned on the top side of the platform over and between the first rear wheel and the second rear wheel.

11. The assembly of claim 10, wherein each of the forward drive actuator and the brake actuator are elongated and aligned along the central axis of the platform, the brake actuator being positioned rearwardly of and adjacent to the forward drive actuator, the first steer actuator being spaced forwardly from the forward drive actuator with respect to the platform, the second steer actuator being spaced forwardly from the forward drive actuator with respect to the platform, the second steer actuator being positioned adjacent to the first steer actuator and extending in the second lateral direction away from the first steer actuator.

12. The assembly of claim 1, wherein the power supply comprises a battery.

13. The assembly of claim 12, further comprising a charging port being electrically coupled to the battery.

14. The assembly of claim 13, further comprising a charging cord being couplable to the charging port for electrically coupling the battery to an external power source to charge the battery.

15. A motorized skateboard assembly comprising:

a platform having a front end and a rear end;

a front bracket and a rear bracket each being coupled to a bottom side of the platform, the front bracket being spaced forwardly of the rear bracket with respect to the rear end of the platform;

a first front wheel and a second front wheel each being rotatably coupled to the front bracket, the first front wheel being spaced from a central axis of the platform extending between each of the front and rear ends of the platform in a first lateral direction, the second front wheel being spaced from the central axis in a second lateral direction opposite the first lateral direction, the first and second front wheels sharing a front rotational axis, the front rotational axis extending laterally in opposite directions with respect to the central axis;

a first rear wheel and a second rear wheel each being rotatably coupled to the rear bracket, the first rear wheel being spaced from the central axis in the first lateral direction, the second rear wheel being spaced from the central axis in the second lateral direction, the first and second rear wheels sharing a rear rotational axis, the rear rotational axis extending laterally in opposite directions with respect to the central axis;

each of the first front wheel, the second front wheel, the first rear wheel, and the second rear wheel being configured to be engageable with a support surface to compel the platform along the support surface when rotated;

a drive system being operatively coupled to each of the first and second front wheels and the first and second rear wheels for rotating each of the first and second front wheels and the first and second rear wheels, the drive system comprising:

a first front motor being mounted on the front bracket and being operatively coupled to the first front wheel;

a second front motor being mounted on the front bracket and being operatively coupled to the second front wheel;

a first rear motor being mounted on the rear bracket and being operatively coupled to the first rear wheel; and a second rear motor being mounted on the rear bracket and being operatively coupled to the second rear wheel;

a control circuit being operatively coupled to the drive system;

an input being electrically coupled to the control circuit for operating the drive system, the input being coupled to a top side of the platform, the input comprising:

a forward drive actuator being actuatable to rotate at least one of the first front wheel, the second front wheel, the first rear wheel, and the second rear wheel such that the platform moves forwardly, the forward drive actuator being positioned on the top side of the platform forward of the first rear wheel and the second rear wheel and spaced rearwardly from the first front wheel and the second front wheel, the forward drive actuator being positioned closer to the first rear wheel and the second rear wheel than to the first front wheel and the second front wheel;

a brake actuator being actuatable to inhibit rotation of each of the first front wheel, the second front wheel, the first rear wheel, and the second rear wheel, each of the forward drive actuator and the brake actuator being elongated and aligned along the central axis of the platform, the brake actuator being positioned on the top side of the platform over and between the first rear wheel and the second rear wheel, the brake actuator being positioned rearwardly of and adjacent to the forward drive actuator;

a first steer actuator being actuatable to rotate at least some of the first front wheel, the second front wheel, the first rear wheel, and the second rear wheel such that the front end of the platform is steered toward the first lateral direction with respect to the rear end of the platform, the first steer actuator being spaced forwardly from the forward drive actuator with respect to the platform; and a second steer actuator being actuatable to rotate at least some of the first front wheel, the second front wheel, the first rear wheel, and the second rear wheel such that the front end of the platform is steered toward the second lateral direction with respect to the rear end of the platform, the second steer actuator being spaced forwardly from the forward drive actuator with respect to the platform, the second steer actuator being positioned adjacent to the first steer actuator and extending in the second lateral direction away from the first steer actuator;

a power supply being electrically coupled to the control circuit, the power supply being mounted to the bottom side of the platform, the power supply comprising a battery;

a charging port being electrically coupled to the battery; and a charging cord being couplable to the charging port for electrically coupling the battery to an external power source to charge the battery.

* * * * *